United States Patent [19]

Sherman

[11] Patent Number: 4,668,340

[45] Date of Patent: May 26, 1987

[54] METHOD OF COUNTERCURRENT ACID HYDROLYSIS OF COMMINUTED CELLULOSIC FIBROUS MATERIAL

[75] Inventor: Michael I. Sherman, Glens Falls, N.Y.

[73] Assignee: Kamyr, Inc., Glens Falls, N.Y.

[21] Appl. No.: 591,373

[22] Filed: Mar. 20, 1984

[51] Int. Cl.[4] ..... D21C 1/04; D21C 3/02; D21C 3/26

[52] U.S. Cl. ..... 162/16; 162/19; 162/39; 162/71; 162/82; 127/37

[58] Field of Search ..... 127/37; 162/16, 19, 162/76, 90, 82, 65, 47, 38, 39, 71, 84; 435/161, 163, 165

[56] References Cited

U.S. PATENT DOCUMENTS

| | | | |
|---|---|---|---|
| 3,380,883 | 4/1968 | Richter et al. | 162/19 |
| 3,413,189 | 11/1968 | Backlund | 162/29 |
| 4,174,997 | 11/1979 | Richter | 162/19 |
| 4,236,961 | 12/1980 | Green | 162/47 |
| 4,427,453 | 1/1984 | Richter | 127/37 |
| 4,436,586 | 3/1984 | Elmore | 162/19 |
| 4,456,750 | 6/1984 | Martalla et al. | 162/84 |

FOREIGN PATENT DOCUMENTS 122608 8/1948 Sweden .

OTHER PUBLICATIONS

"Development of the Alva Prehydrolysis Process; Part Two: Mill Scale Application"; Blom et al, Tappi Proceedings, 1981 Pulping Conference.

"Billerud Pioneers Prehydrolysis-Kraft Pulping", Haas, reprint from Pulp & Paper International, Kamyr, Dec., 1967.

"Continuous Pulping Process", by Rydholm, reprinted by University Microfilms International, Special Technical Assn. Publication, Stap No. 7, pp. 105-119.

*Primary Examiner*—Steve Alvo

*Attorney, Agent, or Firm*—Nixon & Vanderhye

[57] ABSTRACT

A method and apparatus are provided for the treatment of comminuted cellulosic fibrous material to effect prehydrolysis, and then subsequently kraft digestion, thereof, to produce paper pulp. The material is steamed, entrained in liquid to form a suspension, and transferred by a high pressure feeder in a first circulation loop to the top of a first vertical vessel. At the top of the vessel, a liquid/solids separator is provided, and the liquid withdrawn from the top of the first vessel into the return conduit of the first circulation loop includes recoverable hydrolysate (which contains hemicellulose, sugars, and the like). In the first vessel, countercurrent acid hydrolysis takes place in the top of the vessel, and a countercurrent wash is effected in the bottom of the vessel. A part of the liquid in the return conduit of the first circulatory loop is diverted to one or more flash tanks, to produce steam and a liquid with a high concentration of hydrolysate. After hydrolysis and washing, the material is withdrawn from the bottom of the first vessel and passed through a second circulatory loop to the top of a kraft digester, preferably one having a steam phase at the top.

10 Claims, 1 Drawing Figure

METHOD OF COUNTERCURRENT ACID HYDROLYSIS OF COMMINUTED CELLULOSIC FIBROUS MATERIAL

BACKGROUND AND SUMMARY OF THE INVENTION

The invention relates to a method and apparatus for effecting prehydrolysis of comminuted cellulosic fibrous materials (such as wood chips, straw, bagasse, agricultrual wastes, etc.), and for the treatment of such material to effect hydrolysis and subsequent kraft pulping thereof.

Prehydrolysis is practiced to effect removal of hemicellulose, acid soluble lignins, and sugars such as glucose, galactose, mannose, arabinose, and zylose. By practicing prehydrolysis according to the invention, the majority of the hemi-cellulose is hydrolyzed to monoses, and the remaining hemi-cellulose is degraded sufficiently to make it more easily removed during the kraft cook. Little cellulose is hydrolyzed during prehydrolysis, although some acid soluble lignins—as mentioned above—are dissolved. Kraft cooking of the prehydrolyzed cellulosic fiber material performs the primary delignification to produce high alpha cellulose pulp. Prehydrolysis is necessary for the production of dissolving pulp, or for use in the viscous or acetate processes, and in order to facilitate production of a pulp with a 94–97% alpha cellulose content from a kraft digester.

In the prior art there have been two basic approaches to acid prehydrolysis.

In the first prior art approach, a single vessel is utilized to effect prehydrolysis and digestion. Such practice is exemplified by U.S. Pat. Nos. 3,380,883 and 3,413,189. While such an approach can achieve some desired results, it does not allow the separate recovery of the hydrolysate, which is increasingly valuable. Also when scaling or "gunking" occurs due to the mixing of the hydrolysate and kraft liquors, the system must be shut down and cleaned.

The second prior art approach is exemplified by U.S. Pat. No. 4,174,997 and a paper entitled "Development of the Alva Prehydrolysis Process" by Blom, et al, TAPPI 1981 Pulping Conference, pages 409–416. Two-vessel systems have the advantage of maintaining a cleaner separation between the acidic liquors in the prehydrolysis system and the caustic liquors in the kraft system, and provide a clear temperature separation between the lower temperature (e.g., 240°–245° F.) of the prehydrolysis zone and the higher temperature (e.g., 290°–350° F.) of the kraft zone. Typically, hydrolyzing liquid and the material are passed together in a co-current manner, and hydrolyzed compounds are removed from the material through the combined processes of displacement and diffusion. While such procedures can be effective, there is a tendency toward process instability due to variations in the moisture content and the bulk density of the incoming cellulosic material, which will directly affect uniformity of both the withdrawn hydrolysate and the pulp produced by the process.

According to the present invention, a method and apparatus are provided which substantially overcomes the above-mentioned problems. In the practice of the present invention, a two-vessel system is utilized in such manner that it is possible to minimize process variations. This is accomplished, in large part, by operating the hydrolysis reaction zone so that it is totally countercurrent. The practice of the present invention also increases the efficiency of the washing of the hydrolyzed compounds and the residual acids from the cellulosic material so as to reduce the transfer of these compounds to the kraft digester where they consume active chemicals and become involved in undesirable side reactions. The present invention also promotes the early removal of gases generated in the hydrolysis reaction, and thereby facilitates smooth movement of the cellulosic material downwardly through the treatment vessels. The present invention also improves the reaction driving force at the end of the hydrolysis reaction by providing the highest level of acidity (lowest pH level) at the point where the remaining unreacted hemi-celluloses are the lowest, thus the acid charge and/or temperature level of the hydrolyzing liquid can be lower than would be required by the prior art.

As used in the present specification and claims, "acid hydrolysis" means hydrolysis accomplished utilizing a wide range of temperatures and acidity of hydrolyzing liquids. That is, hydrolysis can be carried out at lower temperatures with concentrated acids, at intermediate temperatures with weak acid solutions, or at high temperatures with only water (acid being leached out of the material and contributing to the hydrolysis).

According to one aspect of the present invention, a method of prehydrolyzing comminuted cellulosic fibrous material (e.g., prior to kraft cooking thereof), utilizing a generally vertical vessel, is provided. The method comprises the steps of:

(a) Feeding comminuted cellulosic fibrous material suspended in liquid to a top portion of the vessel.

(b) Effecting countercurrent acid hydrolysis in a top zone of the vessel, as the material passes downwardly in the vessel.

(c) Withdrawing liquid containing recoverable hydrolysate, including hemi-cellulose and sugars, from the top of the acid hydrolysis zone of the vessel, and recirculating the liquid to be fed back to the top of the vessel in step (a).

(d) Diverting a part of the liquid, containing hydrolysate, withdrawn in step (c). And (e) flashing the diverted liquid from step (d) to produce steam and a liquid with concentrated hydrolysate.

The method also contemplates effecting countercurrent washing of the hydrolyzed material in a portion of the vessel below the acid hydrolysis zone thereof, and controlling the upflow of wash liquid by controlling the proportion of liquid diverted in step (d). Typically the total time for passage of a particular unit of material through the acid hydrolysis reaction zone will be a predetermined time between about 30–180 minutes, the predetermined time set depending upon the particular cellulosic material being treated, and other reaction conditions.

According to another aspect of the present invention, there is provided a method for treating comminuted cellulosic fibrous material utilizing first and second generally vertical vessels. Such a method comprises the steps of continuously:

(a) Steaming the comminuted cellulosic fibrous material.

(b) Entraining the steamed cellulosic fibrous material in liquid, to form a suspension.

(c) Transporting the suspension to the top of the first vessel, in a first circulation loop.

(d) Separating liquid from the cellulosic fibrous material at the top of the first vessel, the separate liquid being transported in the first circulation loop, and including hydrolysate including hemi-cellulose, and sugars.

(e) Separating at least a part of the hydrolysate from the liquor in the first circulation loop.

(f) Passing the material downwardly in the first vessel.

(g) Subjecting the downwardly passing material to countercurrent hydrolyzing liquid in a top, hydrolysis reaction zone, of the first vessel.

(h) Effecting washing of the material at the bottom of the first vessel, below the hydrolysis reaction zone.

(i) Feeding the washed, prehydrolyzed, material from the bottom of the first vessel to the top of the second vessel in a second circulation loop. And (j) effecting kraft digestion of the material in the second vessel.

Apparatus for practicing the exemplary cellulosic fibrous material treating method according to the present invention typically includes the following components: (a) A steaming vessel. (b) A continuous high pressure feeder for feeding steamed material, entrained in liquid, at high pressure. (c) A first generally vertical vessel. (d) A liquid-solids separator disposed adjacent the top of the first vessel. (e) A first circulatory loop between the high pressure feeder and the liquid-solid separator. (f) first withdrawal screens at a central vertical portion of said first vessel. (g) Hydrolyzing liquid introduction means adjacent the first withdrawal screens. (h) A hydrolyzing liquid circulatory loop, including a pump and heating means, operatively connected between the structures (f) and (g). (i) Means for introducing wash liquid at a bottom portion of said vessel, below the first withdrawal screens. (j) Means for discharging hydrolyzed material from the bottom of the first vessel. (k) A second generally vertical vessel, comprising a kraft continuous digester. (l) A second circulatory loop interconnecting the means (j) and the top of the continous kraft digester. (m) Means for diverting a portion of the liquid in the return portion of the first circulatory loop. And (n) means for removing hydrolysate from the liquid diverted by means (m).

It is the primary object of the present invention to provide a method and apparatus for treating cellulosic fibrous material to effect acid prehydrolysis thereof in an efficient and effective manner so as to produce pulp of uniform quality, maximize the efficiency of the subsequent kraft digestion stage, and effect withdrawal of high quality hydrolysate. This and other objects of the invention will become clear from an inspection of the detailed description of the invention, and from the appended claims.

DETAILED DESCRIPTION OF THE DRAWING

Figure 1:
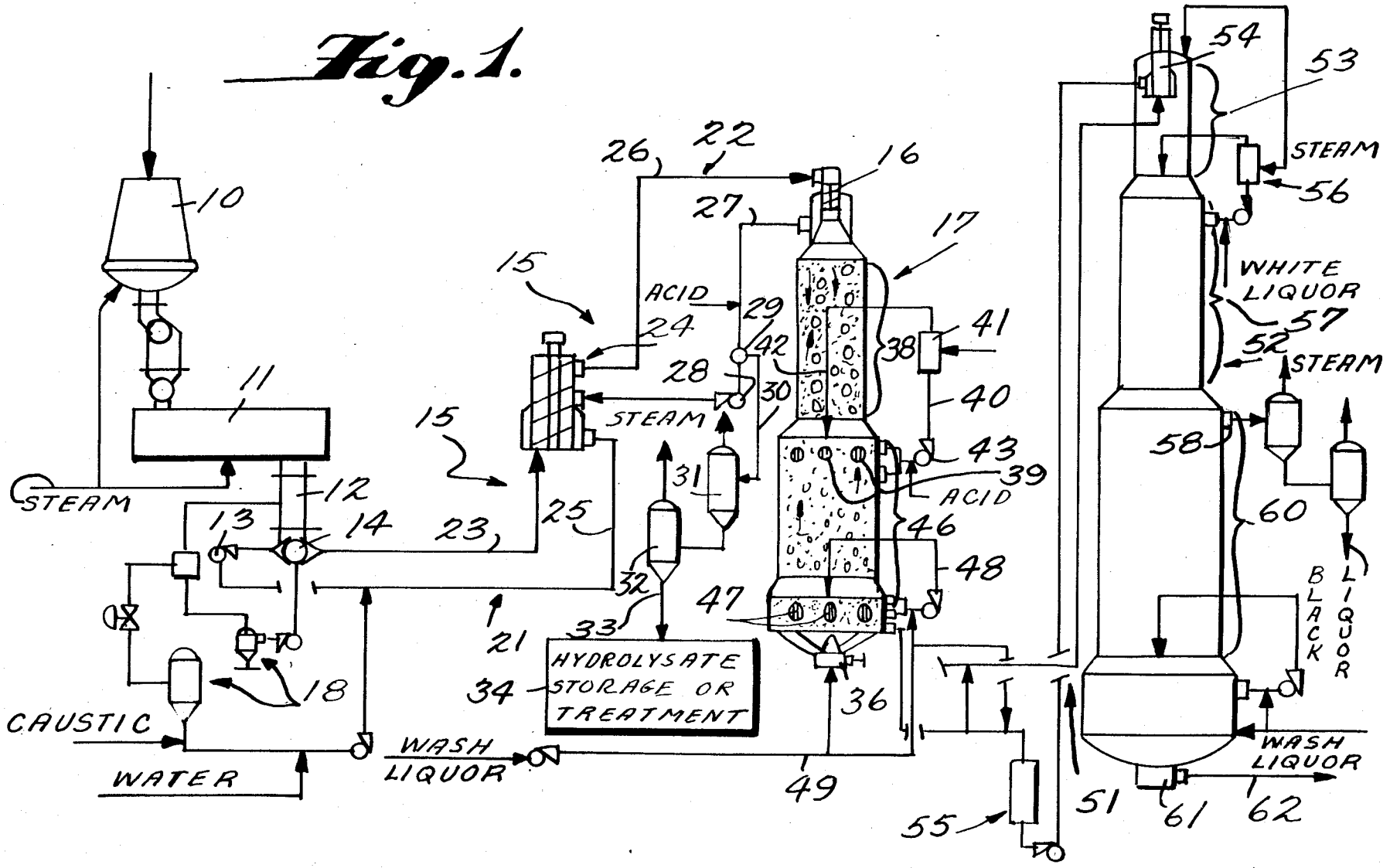
FIG. 1 is a schematic view of exemplary apparatus according to the present invention.

An exemplary apparatus for the practice of the present invention is illustrated schematically in FIG. 1. In describing the apparatus, and the method, according to the present invention, reference will be made to the treatment of wood chips, but it is to be understood that the invention may be practiced with a wide variety of comminuted cellulosic fibrous materials including straw, bagasse, and agricultural wastes. It is noted that all of the individual apparatus elements illustrated in FIG. 1 are known per se, and readily commercially available.

The chips are fed from a chips bin 10 to a low pressure steamer 11. Some presteaming can also be effected in the bin 10, or under suitable circumstances all of the steaming may be effected in the bin 10 and the vessel 11 eliminated. After steaming to remove air from the chips, and preheat them, the chips are fed to conduit 12 in which a predetermined level of liquid is maintained, and the chips are entrained in liquid. The chips are then pumped, under the influence of the high pressure pump 13 of the high pressure feeder 14 (also known as a high pressure transfer device, and including a rotor having a plurality of diametrically through-extending pockets) to a first circulatory loop 15, the chips—now in a suspension with the entraining liquid—ultimately passing to a liquid/solid separator 16 adjacent the top of a first generally vertical vessel 17. The desired amount of entraining liquid (and liquid level) for the high pressure feeder and the circulatory loop 15 are maintained by the conventional system 18.

In order to protect the high pressure feeder 14 from the acidic environment of the prehydrolysis stage in the vessel 17, the first circulatory loop 15 is preferably divided into first and second subloops, 21, 22. Caustic is added to the liquid (primarily water) in the first subloop 21, the subloop 21 including a conduit 23 leading from feeder 14 to a liquid-liquid exchanger 24, and a return conduit 25 leading from the exchanger 24 back to the feeder 14. The second subloop 22 includes a conduit 26 leading from exchanger 24 to the top of vessel 17, and a return conduit 27 from the top of vessel 17 back to the exchanger 24. A pump 28, and a valve 29 are provided in the return conduit 27, the valve 29 diverting a variable, but predetermined, amount of liquid in return conduit 27 to diverting conduit 30. The diverting conduit 30 leads to one or more (preferably a series of) flash tanks 31, 32, with a liquid transporting conduit 33 extending from the bottom of the last flash tank 32 to a hydrolysate storage or treatment station 34.

The chips fed into the separator 16 at the top of first, liquid filled, vessel 17 pass downwardly in the vessel 17 until they are ultimately discharged from the bottom of first vessel 17 utilizing a conventional discharge device 36, such as a rotating scraper and/or sluicing nozzles, and the like. The top part 38 of the first vessel 17—from the separator 16 to the first set of withdrawal screens 39—defines an acid hydrolysis reaction zone, where countercurrent acid hydrolysis takes place. The screens 39 typically are of the stave-type and are preferably constructed so that they can be easily cleaned when the vessel 17 is emptied.

Countercurrent acid hydrolysis is preferably practiced in the zone 38 by withdrawing liquid through screens 39 into conduit 40, heating the liquid in the conduit 40—as by utilizing indirect steam heater 41—and then returning it through conduit 42 into a central portion of the vessel 17, vertically adjacent (although radially spaced from) the screens 39, the liquid flowing upwardly in zone 38, countercurrent to the downward passage of the chips throughout the entire zone 38. As previously mentioned, hydrolysis can be effected by heating the liquid with heater 41 to a sufficiently high temperature. However, it is preferable to add at least a small amount of mineral acid (such as sulfuric acid) to the suction side of pump 43 in conduit 40, the acid regulating the pH of the hydrolyzing liquid. The pH value will be varied depending upon the particular chips (or other cellulosic fibrous material) being treated, and a conventional temperature controlling loop (not shown) is used to control the temperature of the hydrolyzing liquid in conduits 40, 42.

In the bottom of the vessel 17, between the hydrolysis zone 38 and the discharge device 36, a washing zone 46 is provided. Liquid is withdrawn through screens 47 adjacent the bottom of the zone 46, and is circulated through wash circulation loop 48—to which fresh wash liquid is added via line 49—to the interior of the vessel 17, vertically adjacent the screens 47 but radially spaced therefrom. The wash liquid flows upwardly in the vessel 17, countercurrent to the downwardly flowing chips.

The discharge device 36 discharges the hydrolyzed, washed, chips (entrained in the liquid) into the second circulatory loop 51, which is connected to the top of a continuous kraft digester 52. The digester 52 preferably is the type having a steam phase 53 at the top thereof, and an inverted top separator 54 is provided. During transfer of the chips in circulatory loop 51, they may be heated to temperatures (e.g., 290°-320° F.) approaching those required for a kraft cook utilizing the indirect steam heater 55. The steam phase digester 52 may be operated with either a co-current or a countercurrent reaction zone depending upon the requirements of the final product. In the drawing, the digester 52 is shown operating in the co-current mode with the cooking circulation loop 56 located at the top of the kraft reaction zone 57, while the black liquor extraction point 58 is at the lower end of the kraft reaction zone 57. When operated in the countercurrent mode, these locations are reversed.

The kraft reaction zone 57 typically is followed by a countercurrent wash zone 60 which effects removal of unwanted material (such as dissolved lignin and residual kraft cooking chemicals) by the combined mechanisms of displacement and diffusion. The washed pulp is discharged from the digester 52 utilizing a conventional discharge device 61, and then is passed via line 62 to further treatment stages, such as storage and washing stages. The pulp discharged in line 62 is typically high alpha cellulose pulp, and usually is further processed in bleaching operations to produce a desired end product pulp.

Method

In the practice of, specifically, the prehydrolysis of cellulosic fibrous material according to the present invention, chips, entrained in liquid, are fed to the top of the vessel 17, and countercurrent acid hydrolysis is effected in zone 38 as the chips pass downwardly in the vessel 17. Liquid is withdrawn through return conduit 27 from the top of the zone 38, the withdrawn liquid in conduit 27 including hydrolysate (containing hemi-cellulose, acid soluble lignin, and sugars such as glucose, gelactose, manose, arabinose, and xylose). Valve 29 is operated to divert a predetermined proportion of the liquid in conduit 27 from the circulatory subloop 22, the diverted liquid being flashed so as to produce steam and a liquid (in conduit 33) having an increased, high, concentration of hydrolysate. At stage 34, the hydrolysate is stored, and ultimately processed, or it may be immediately processed to produce alcohol via fermentation, to produce cattle food supplements by evaporation, or to produce other organic chemicals utilizing a wide variety of other chemical processes.

In the practice of the entire chips treatment process according to the present invention, the chips are steamed in vessels 10 and 11, entrained in caustic liquid in chute 12 and high pressure transfer device 14, passed through liquid-liquid exchanger 24 so that they are entrained in an acidic liquid, and passed to separator 16 at the top of vessel 17. Passing downwardly in vessel 17, the chips are subjected to countercurrent acid hydrolysis in zone 38, and countercurrent washing in washing zone 46. A part of the liquid in return conduit of circulatory subloop 22 is diverted through valve 29 to conduit 30, and is flashed in flash tanks 31, 32 to produce steam and a concentrated hydrolysate liquid in conduit 33. The valve 29 is operated to control the amount of liquid being diverted to conduit 30, and this in turn regulates (i.e., controls) the wash liquor upflow rate in zone 46.

Hydrolyzed, washed, chips are discharged through mechanism 36 from vessel 17, and passed to separator 54 in the steam phase 53 of kraft digester 52. After kraft cooking and countercurrent washing in digester 52, the high alpha cellulose pulp produced is discharged by device 61 into conduit 62 for further treatment.

By providing total countercurrent acid prehydrolysis of the chips, process variations are minimized, and a uniform quality of pulp can be produced. Also, the efficiency of the washing of the hydrolyzed compounds and the residual acids from the chips reduces the transfer of those compounds to the kraft digester. Further, early removal of gases generated in the hydrolysis reaction is provided, and the reaction driving force at the end of the hydrolysis reaction zone 38 is improved by providing the highest level of acidity at the point (adjacent screens 39) where the remaining unreacted hemicelluloses are the lowest. Thus the acid charge and/or temperature level in the reaction zone can be lower than otherwise would be required.

The reaction parameters will vary widely depending upon the particular material being treated, and the like. However, a typical temperature in the zone 38 would be 240°-285° F., with the pressure in the circulatory loop 15 (and vessel 17) of about 150-250 psig. The method steps are preferably practiced so as to maintain each unit of chips in the zone 38 for a predetermined period of time which will be between about 30-180 minutes.

It will thus be seen that according to the present invention a method and apparatus have been provided for the efficient, effective prehydrolysis of comminuted cellulosic fibrous material, to produce high, uniform, quality pulp. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A method of prehydrolyzing comminuted cellulosic fibrous material to remove hemi-cellulose and sugars therefrom, and utilizing a generally vertical substantially liquid-filled vessel, comprising the steps of:

(a) feeding comminuted cellulosic fibrous material suspended in liquid to a top portion of the vessel;

(b) effecting countercurrent acid hydrolysis in a top zone of the vessel, as the material passes downwardly in the vessel;

(c) withdrawing liquid containing hydrolysate, including hemi-cellulose and sugars, from the top of the acid hydrolysis zone of the vessel, and recirculating the liquid to be fed back to the top of the vessel in step (a);

(d) diverting a part of the liquid, containing hydrolysate, withdrawn in step (c);

(e) flashing the diverted liquid from step (d) to produce steam and a high concentration hydrolysate liquid;

(f) effecting countercurrent washing of the material after the acid hydrolysis zone;

wherein the washing takes place in the vessel in a washing zone below the acid hydrolysis zone; and wherein step (d) is practiced by: withdrawing liquid from a central portion of the vessel, between the hydrolysis reaction zone and the washing zone thereof; adding fresh mineral acid to the liquid withdrawn at the central portion of the vessel; heating the withdrawn liquid; and reintroducing the withdrawn liquid in the vessel at the interface between the hydrolysis reaction zone and the wash zone, so that the acid flows upwardly in the hydrolysis reaction zone, countercurrent to the material.

2. A method as recited in claim 1 comprising the further step of: (f) effecting countercurrent washing of the material as it moves downwardly in the vessel, in a zone of the vessel below the acid hydrolysis zone.

3. A method as recited in claim 1 wherein the washing takes place in the vessel in a washing zone below the acid hydrolysis zone; and comprising the further step of controlling the wash liquor upflow rate in the vessel washing zone by controlling the proportion of liquid in the first circulatory loop diverted in step (d).

4. A method as recited in claim 1 wherein steps (a) through (f) are practiced so that the material remains in the acid hydrolysis zone for a predetermined period of time of between about 30–180 minutes.

5. A method as recited in claim 1 wherein step (a) is practiced by: entraining the material in a caustic liquid; feeding the material entrained in caustic liquid by way of a high pressure feeder to a liquid-liquid exchanger; replacing the caustic liquor with acidic hydrolysis liquor in the liquid-liquid exchanger; and feeding the material entrained in acidic hydrolysis liquid from the liquid-liquid exchanger to the top portion of the vessel.

6. A method as recited in claim 5 comprising the further step of maintaining the suspension in the first circulation loop at 150–250 psig.

7. A method as recited in claim 1 wherein the liquid withdrawn from the central portion of the first vessel is heated to a temperature of about 240°–285° F. before being returned to the vessel.

8. A method as recited in claim 1 wherein step (b) is heated by flowing a heated mineral acid countercurrent to the material in the top zone of the vessel, to effect hydrolysis.

9. A method for treating comminuted cellulosic fiber material utilizing first and second generally vertical vessels, comprising the steps of continuously:

(a) steaming the comminuted cellulosic fibrous material;

(b) entraining the steamed material in liquid, to form a suspension;

(c) transporting the suspension to the top of the first vessel, in a first circulation loop;

(d) separating liquid from the cellulosic fibrous material adjacent the top of the first vessel, the separated liquid being transported in the first circulation loop, and including recoverable hydrolysate, including hemi-cellulose and sugars;

(e) separating at least a part of the hydrolysate from the liquor in the first circulation loop by: (e1) diverting a portion of the liquor in the return part of the first circulation loop; and (e2) flashing the diverting portion to produce steam and hydrolysate;

(f) passing the material downwardly in the first vessel;

(g) subjecting the downwardly passing material to countercurrent hydrolyzing liquid in a top, hydrolysis reaction zone, of the first vessel withdrawing liquid from a central portion of the first vessel, between the hydrolysis reaction zone and the washing zone thereof; adding fresh mineral acid to the liquid withdrawn at the central portion of the first vessel; heating the withdrawn liquid; and reintroducing the withdrawn liquid in the first vessel at the interface between the hydrolysis reaction zone and the wash zone, so that the acid flows upwardly in the hydrolysis reaction zone, countercurrent to the material;

(h) effecting washing of the material at the bottom of the first vessel, below the hydrolysis reaction zone;

(i) feeding the washed, prehydrolyzed, material from the bottom of the first vessel to the top of the second vessel in a second circulation loop; and (j) effecting kraft digestion of the material in the second vessel.

10. A method as recited in claim 9 wherein steps (c) through (i) are practiced so that the material is maintained in the hydrolysis reaction zone for a time period between about 30–180 minutes.

* * * * *